US010486439B2

(12) United States Patent
Hofstra et al.

(10) Patent No.: US 10,486,439 B2
(45) Date of Patent: Nov. 26, 2019

(54) RADIATION-CURABLE INKJET INK COMPOSITION

(71) Applicant: Océ Holding B.V., Venlo (NL)

(72) Inventors: Ronald M. J. Hofstra, Venlo (NL); Marcellus W. P. Van De Put, Someren (NL); Richard F. E. Van Hout, Bladel (NL); Mark M. J. Gosens, Gilze (NL); Gerardus P. M. Van Den Beuken, Lottum (NL); Arend M. Van Buul, Malden (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 16/131,361

(22) Filed: Sep. 14, 2018

(65) Prior Publication Data

US 2019/0092045 A1 Mar. 28, 2019

(30) Foreign Application Priority Data

Sep. 25, 2017 (EP) ..... 17192982.1

(51) Int. Cl.
*B41J 11/00* (2006.01)
*B41J 3/407* (2006.01)

(52) U.S. Cl.
CPC ..... *B41J 11/002* (2013.01); *B41J 11/0015* (2013.01); *B41J 3/4078* (2013.01)

(58) Field of Classification Search
CPC ..... B41J 11/002; B41J 11/0015; B41J 3/4078
USPC ..... 347/100–102
See application file for complete search history.

(56) References Cited

FOREIGN PATENT DOCUMENTS

| | | |
|---|---|---|
| EP | 1 905 611 A2 | 4/2008 |
| EP | 2 042 335 A2 | 4/2009 |
| EP | 2 053 100 A1 | 4/2009 |

OTHER PUBLICATIONS

Search Report issued in European Patent Application No. 17192982, completed Mar. 19, 2018.

*Primary Examiner* — An H Do
(74) *Attorney, Agent, or Firm* — Birch, Stewart, Kolasch & Birch, LLP

(57) ABSTRACT

The present invention relates to a method for applying an image onto a recording medium. The method involves applying an undercoat liquid onto the recording medium and semi-curing the undercoat liquid. Further, the method involves applying an image onto the semi-cured undercoat liquid and curing said image. The invention further relates to a printer apparatus configured for performing such method.

8 Claims, 3 Drawing Sheets

RADIATION-CURABLE INKJET INK COMPOSITION

The present invention relates to a method for applying an image onto a recording medium. Further, the invention relates to a printer apparatus configured for performing such method.

BACKGROUND OF THE INVENTION

Methods for applying an image onto a recording medium using a radiation-curable ink are known in the art. Generally, such methods comprise the step of applying the UV curable ink onto a recording medium, e.g. by jetting droplets of the ink using an ink jet printer.

When applying an image onto a recording medium using a radiation-curable ink composition, it is desired that the ink applied onto the recording medium adheres well to the recording medium. If the ink does not adhere well, the printed image may be easily damaged, which is unwanted.

It is known to improve adhesion of an ink layer to a recording medium by applying an undercoat liquid onto the recording medium before applying the ink. An undercoat liquid is also known in the art as primer layer. The undercoat liquid may comprise a radiation-curable component, for example a UV-curable component.

However, even when applying an undercoat liquid, the adhesion may not be satisfactory.

It is therefore an object of the present invention to provide a method for applying an image onto a recording medium, wherein the adhesion of the image is improved.

SUMMARY OF THE INVENTION

The object of the invention is achieved in a method for applying an image onto a recording medium, the method comprising the steps of:

a. applying an undercoat liquid onto the recording medium, wherein the undercoat liquid is radiation-curable composition comprising a cationically polymerisable component and a cationic photo-initiator;
b. semi-curing the undercoat liquid applied onto the recording medium;
c. applying a radiation-curable ink composition on the semi-cured undercoat liquid, wherein the radiation-curable ink composition comprising a cationically polymerisable component and a radical photo-initiator;
d. curing the radiation-curable ink composition and the undercoat liquid.

In the method according to the present invention, an image is provided onto a recording medium. The image may provide the recording medium with visual information. The visual information may comprise text, pictures, etc. The image may be provided for decorative purposes.

In the method according to the present invention, in step a), an undercoat liquid is applied onto the recording medium wherein the undercoat liquid is radiation-curable composition comprising a cationically polymerisable component and a cationic photo-initiator. The recording medium may be in sheet or a web. The recording medium may be e.g. a paper medium, a vinyl medium or a textile medium.

The undercoat liquid is radiation-curable composition comprising a cationically polymerisable component. The cationically polymerisable component may be a monomer, an oligomer or a polymer that is polymerisable by a cationic polymerisation reaction. Examples of components that are polymerisable by a cationic polymerisation reaction are vinylethers and epoxides. Vinylethers and epoxides suitable for polymerizing by a cationic polymerisation reaction are known in the art. In the context of the present invention, a cationically polymerisable component is a component that is polymerisable at least by a cationic polymerization mechanism. In the context of the invention, a cationic polymerisable component may be a hybrid component, i.e. a component that is polymerisable by a cationic polymerisation reaction and another polymerization reaction. Such hydrid components may be polymerizable by a radical polymerization reaction in addition to a cationic polymerization reaction. An example of a hybrid component is a vinylether acrylate.

The undercoat liquid further comprises a cationic photo-initiator, also known as cationic polymerization initiator. Additionally, the undercoat liquid may comprise a sensitizer. A photo-initiator is a compound that generates a reactive species when exposed to radiation. A cationic photo-initiator generates a cationic reactive species when exposed to suitable radiation, preferably UV radiation. Examples of cationic polymerization initiators and sensitizers are known in the art. The undercoat liquid may optionally comprise a solvent, such as an organic solvent or water.

The undercoat liquid is preferably a colorless or a white liquid.

The method used to apply the undercoat liquid onto the recording medium is not limited. For example, the undercoat liquid may be applied by jetting droplets of the liquid onto the recording medium. Alternatively, the undercoat liquid may be applied using a roller.

In the method according to the present invention, in step b), the undercoat liquid applied onto the recording medium is semi-cured.

In the context of the present invention, semi-cured means incompletely cured, i.e. partially cured.

In the present invention, the semi-cured undercoat liquid may be fluid. The semi-cured undercoat may have a low viscosity. Alternatively, the semi-cured undercoat may have a high viscosity. Thus, the semi-cured may be deformable upon application of a mechanical force, such as rubbing. Whether the undercoat liquid is semi-cured may be tested by pressing a sheet of paper onto the recording medium provided with the undercoat liquid, and subsequently removing the sheet of paper. If the undercoat liquid is (partially) transferred onto the sheet of paper, the undercoat layer was semi-cured. If the undercoat liquid is not transferred onto the sheet of paper, the undercoat layer was fully cured.

The step of semi-curing the ink may be performed by a curing unit. The curing unit may comprise a source of suitable radiation, preferably UV radiation. Example of UV radiation sources are UV lamps, such as UV LED lamps and Hg bulbs. UV LEDs are preferred, because they are energy efficient and because the intensity of the radiation emitted by UV LEDs can be easily adjusted. Optionally, the curing unit may comprise more than one source of radiation. If the curing unit comprises more than one source of radiation, the sources of radiation within the curing unit may differ from one another with regard to intensity of the radiation emitted and/or wavelength of the radiation emitted and/or position with regard to the recording medium.

In the method according to the present invention, in step c), a radiation-curable ink composition is applied on the semi-cured undercoat liquid, wherein the radiation-curable ink composition comprising a cationically polymerisable component and a radical photo-initiator.

The radiation-curable ink composition is radiation-curable composition comprising a cationically polymerisable component. The cationically polymerisable component may be a monomer, an oligomer or a polymer that is polymerisable by a cationic polymerisation reaction. Examples of components that are polymerisable by a cationic polymerisation reaction are vinylethers and epoxides. Vinylethers and epoxides suitable for polymerizing by a cationic polymerisation reaction are known in the art. In the context of the present invention, a cationically polymerisable component is a component that is polymerisable at least by a cationic polymerization mechanism. In the context of the invention, a cationic polymerisable component may be a hybrid component, i.e. a component that is polymerisable by a cationic polymerisation reaction and another polymerization reaction. Such hydrid components may be polymerizable by a radical polymerization reaction in addition to a cationic polymerization reaction. An example of a hybrid component is a vinylether acrylate.

The ink composition further comprises a radical photo-initiator. A radical photo-initiator is a component that generates a radical upon excitation with suitable radiation preferably UV radiation. Examples of radical photoinitiator suitable for use in an ink composition are known in the art.

The radiation-curable ink composition may further comprise a cationic polymerization initiator. Additionally, the ink composition may comprise a sensitizer. Examples of cationic polymerization initiators and sensitizers are known in the art.

The radiation-curable ink composition may further comprise a colorant. Examples of colorants are dyes and pigments. The ink composition may comprise one or more pigment and/or one or more dye.

The radiation-curable ink composition may optionally comprise a solvent, such as an organic solvent or water. The radiation-curable ink composition may further comprise additional components, such as one or more inhibitors, one or more biocides, and one or more fungicides.

The method used to apply the radiation-curable ink composition onto the recording medium is not limited. For example, the undercoat liquid may be applied by jetting droplets of the liquid onto the recording medium. Droplets may be jetted by a print head. Various types of print heads are known in the art, such as piezo-electric print heads and thermal print heads.

The radiation-curable ink composition is applied onto the semi-cured undercoat fluid. The semi-cured undercoat fluid may be fluid. Without wanting to be bound to any theory, it is believed that application of the droplets on the semi-cured undercoat liquid brings about mixing between the undercoat liquid and the radiation-curable ink composition. The semi-cured undercoat liquid may be fluid. When the radiation-curable ink composition is applied onto the semi-cured undercoat liquid, the surface of the undercoat liquid may be agitated by the radiation-curable ink and the ink and undercoat liquid may mix, thereby forming a mixture of the undercoat liquid and the radiation-curable ink. Mixing of the two fluids may result in increased physical interactions between the undercoat liquid and ink applied onto the medium. This increased physical interaction may increase the cohesion between the fluids. As a result the fluid layer—comprising both undercoat layer and ink-applied onto the recording may be attached more strongly to the recording medium.

In the method according to the present invention, in step d), the radiation-curable ink composition and the undercoat liquid are cured.

By curing the ink, the ink layer including the undercoat liquid may be fixed onto the recording medium and an ink surface may be formed on the recording medium. The step of curing the ink may be performed by a curing unit. The curing unit may comprise a source of suitable radiation, preferably UV radiation. Example of UV radiation sources are UV lamps, such as UV LED lamps and Hg bulbs. UV LEDs are preferred, because they are energy efficient and because the intensity of the radiation emitted by UV LEDs can be easily adjusted. Optionally, the curing unit may comprise more than one source of radiation. If the curing unit comprises more than one source of radiation, the sources of radiation within the curing unit may differ from one another with regard to intensity of the radiation emitted and/or wavelength of the radiation emitted and/or position with regard to the recording medium.

By curing the ink and the undercoat liquid, a robust layer, comprising both radiation-curable ink and undercoat layer, may be formed.

In an embodiment, the ink composition further comprises a radically polymerisable component.

A radically polymerisable component may have a higher rate of polymerization than a cationically polymerisable component. Thus, by adding a radically polymerisable ink component to the ink composition, the overall polymerization rate of the ink may increase. As a result, the ink needs less time to reach a high degree of curing upon irradiation with a suitable source of radiation. By decreasing the time needed to reach a high degree of curing, the speed of the printing process (including curing) may be increased, thereby rendering the process more productive.

The radically polymerisable component may be a (meth) acrylate. The (meth)acrylate may be a monofunctional acrylate, a difunctional acrylate, a trifunctional acrylate, a tetrafunctional acrylate or a multifunctional acrylate, i.e. an acrylate comprising more than four acrylates groups. Additionally or alternatively, the acrylate may be an oligomer or a polymer comprising at least one acrylate group. The ink composition may comprise only one radically polymerisable component. Alternatively, the ink composition may comprise a plurality of radically polymerisable components.

In an embodiment, the ink composition further comprises a gelling agent. The gelling agent may provide the ink with gelling properties. A gelling ink may be fluid at elevated temperatures and may be in a gelled state at lower temperatures. The temperature at which a gel is formed is referred to as gelling temperature. The gelling temperature may be suitably controlled by selecting an appropriate gallant. Examples of suitable gellants are waxes, such as vegetable waxes, such as candelila wax, carnauba wax, rice wax, jojoba wax, animal waxes, such as bees wax and mineral waxes, such as montan wax, fatty acids, fatty alcohols, fatty acid amides, fatty acid esters and ketones.

In an embodiment, the recording medium is a textile medium. Textile media may be used for making clothing. Clothing may easily come into contact with skin. When the medium comes into contact with the skin, it is important that no unreacted polymerisable material is present.

Textile media may tend to absorb fluids that are applied on the medium. When fluids are absorbed by a medium, it may be difficult to cure the fluids, such as radiation-curable ink compositions.

When polymerization of the cationically polymerisable component present in the undercoat liquid and the ink composition has been started by curing and semi-curing, then this polymerization reaction may continue after irradiation has stopped. This may further reduce the amount of non-reacted polymerizable component, thereby increasing the safety of the print. When radically polymerizable components are present in the ink, though, polymerization of these components may stop when irradiation is stopped.

By applying an undercoat liquid and semi-curing the undercoat liquid in accordance with the present invention, absorption of the ink by the textile medium may be prevented. Therefore, the method according to the present invention is advantageous when textile media are used.

In an embodiment, the cationically polymerisable component is a component that is both cationically and radically polymerisable. The cationically polymerisable component may comprise both a reactive group that can undergo a polymerization reaction via a cationic reaction mechanism and a reactive group that can undergo a polymerization reaction via a radical reaction mechanism. Such components are also referred to as hybrid monomers.

Examples of hybrid monomers are vinylether acrylates, vinylacrylates, and epoxyacrylates.

Hybrid monomers may undergo both cationic and radical polymerization. A hybrid monomer may react with another hydrid monomer in a polymerization reaction. Alternatively or additionally, the cationically polymerizable group of the hybrid monomer may react with another cationically polymerizable component and/or the radically polymerizable group of the hybrid monomer may react with another radically polymerizable component. Thus, the hybrid monomer may enable crosslinking in the ink, optionally crosslinking between different components in the ink.

Crosslinking may increase the robustness of the ink layer.

In a further embodiment, the cationically polymerisable component is a vinylether acrylate.

A vinylether acrylate is an example of a hybrid monomer. The vinylether group may undergo a polymerization reaction via a cationic polymerization mechanism, whereas the acrylate group may undergo a polymerization reaction via a radical polymerization mechanism. Vinylether acrylates may be suitably used as hybrid monomer in an ink. Examples of vinylether acrylates are VEEA (2-(2-vinyloxy ethoxy)ethyl acrylate) and VEEM (2-(2-vinyloxy ethoxy) ethyl methacrylate)

In an embodiment, the method further comprises the step of:

e) Heating the radiation-curable ink composition and the undercoat liquid applied onto the recording medium.

When the radiation-curable ink composition and the undercoat liquid are cured, it may occur that some traces of uncured material are still present. This uncured material may comprise non-reacted polymerisable material, such as (meth)acrylates, vinyls, epoxides and/or vinylethers. The presence of uncured material is unwanted for several reasons. Uncured material may provide the printed product with an unpleasant smell. Further, printed products, comprising uncured material that, come into contact with human skin, this may result in skin irritations.

Radiation for curing the curable material an ink may not always penetrate deep enough into the ink layer to effectuate curing. Curing may also be effectuated by heat. Heat may penetrate deeper into the ink layer compared to UV light. Therefore, traces of uncured material may be converted into cured material by providing heat to the radiation-curable ink composition and the undercoat liquid applied onto the recording medium. Heating may be performed by suitable heating means. For example, the recording medium provided with the ink and undercoat liquid may be brought into contact with a heater roller. Additionally or alternatively, the recording medium provided with the ink and undercoat liquid may be irradiated by an IR heater.

Preferably, step e) is performed after step d).

In an aspect of the invention, a printer apparatus is provided, the printer apparatus comprising

- a first application unit for applying an undercoat liquid onto a recording medium;
- a second application unit for applying a radiation-curable ink composition;
- a curing unit; and
- a control unit configured to control the printer to perform a method in accordance with the present invention.

The printer apparatus comprises a first application unit for applying an undercoat liquid onto a recording medium. The first application unit may comprise a spray nozzle for applying the undercoat liquid. Alternatively or additionally, the first application unit may comprise a print hear for ejecting droplets. Alternatively or additionally, the first application unit may comprise a roller for applying an undercoat liquid onto a recording medium. The first application unit may be operatively connected to an undercoat liquid reservoir.

The printer apparatus further comprises a second application unit for applying a radiation-curable ink composition. The second application unit may comprise a print head. Preferably, the second application unit may comprise a plurality of print heads. The second application unit may be operatively connected to an ink reservoir for storing the radiation-curable ink composition.

The printer apparatus further comprises a curing unit. The curing unit may be configured for semi-curing the undercoat liquid and for curing the ink layer including the undercoat liquid. The curing unit may comprise a source of suitable radiation, preferably UV radiation. Example of UV radiation sources are UV lamps, such as UV LED lamps and Hg bulbs. UV LEDs are preferred, because they are energy efficient and because the intensity of the radiation emitted by UV LEDs can be easily adjusted. Optionally, the curing unit may comprise more than one source of radiation. If the curing unit comprises more than one source of radiation, the sources of radiation within the curing unit may differ from one another with regard to intensity of the radiation emitted and/or wavelength of the radiation emitted and/or position with regard to the recording medium.

Preferably, the printer apparatus comprises a semi-curing unit in addition to the curing unit. The semi-curing unit may comprise a source of suitable radiation, preferably UV radiation. Example of UV radiation sources are UV lamps, such as UV LED lamps and Hg bulbs.

In an embodiment, the printer further comprises heating means.

The heating means may be configured to heat the recording medium including the ink layer and including the undercoat liquid. The heating means may comprise e.g. a heater roller. Additionally or alternatively, the heating means may comprise an IR heater.

The heating means may be provided downstream of the curing means in a direction of paper transport.

In an embodiment, the curing unit comprises a first curing unit for semi-curing the undercoat liquid and a second curing unit for curing the radiation-curable ink composition.

BRIEF DESCRIPTION OF THE DRAWINGS

These and further features and advantages of the present invention are explained hereinafter with reference to the accompanying drawings showing non-limiting embodiments and wherein.

In the drawings, same reference numerals refer to same elements.

DETAILED DESCRIPTION OF THE DRAWINGS

Figure 1:
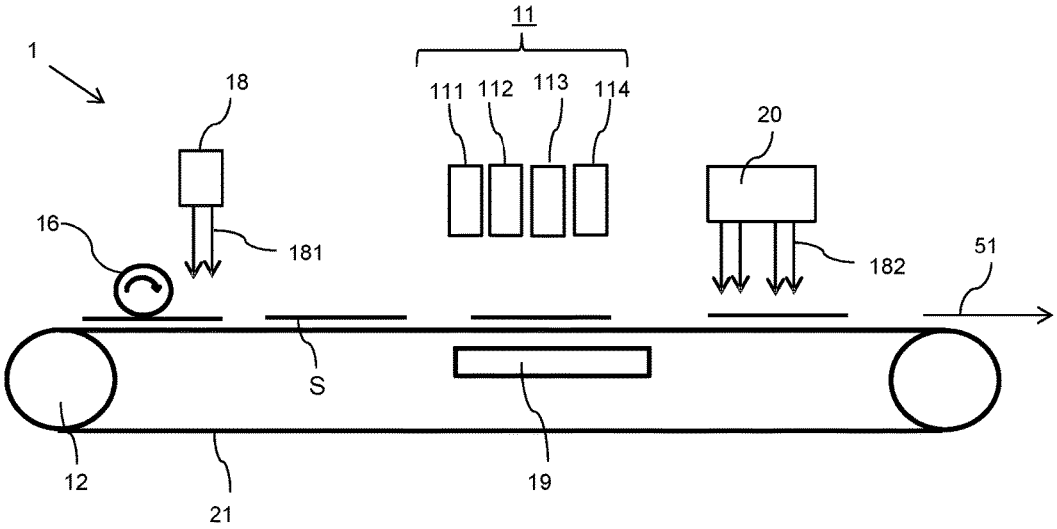
FIG. 1 shows a schematic representation of a first example of an inkjet printing system.

FIG. 1 shows a schematic representation of a first example of an inkjet printing system 1. FIG. 1 shows that a sheet S of a receiving medium is transported in a direction for conveyance as indicated by arrow 51 and with the aid of transportation mechanism 12. Transportation mechanism 12 may be a driven belt system comprising an endless belt 21. Optionally, the driven belt system may comprise a plurality of belts. Alternatively, one or more of these belts may be exchanged for one or more drums. A transportation mechanism may be suitably configured depending on the requirements (e.g. sheet registration accuracy) of the sheet transportation in each step of the printing process and may hence comprise one or more driven belts and/or one or more drums. For a proper conveyance of the sheets of receiving medium, the sheets need to be fixed to the transportation mechanism. The way of fixation is not particularly limited and may be selected from electrostatic fixation, mechanical fixation (e.g. clamping) and vacuum fixation. Of these vacuum fixation is preferred.

The printing process as described below comprises of the following steps: media pre-treatment, image formation and fixing.

Media Pre-treatment

The receiving medium may be pretreated, i.e. treated prior to printing an image on the medium. The pre-treatment step may comprise a primer pre-treatment. Providing a primer to the medium may increase the adhesion of a print onto the medium. A primer is also known as an undercoat liquid.

In the inkjet printing system shown in FIG. 1, the primer is applied by a roller 16. However, alternatively, the primer could be applied by a different way, e.g. using a curtain coater or a spray coater. The roller may be in fluid communication with a primer reservoir (not shown).

After the primer has been applied onto the sheet S of the recording medium, the recording medium is conveyed in the direction indicated by arrow 51 and the sheet moves underneath pre-curing unit 18. The pre-curing unit emits radiation—schematically depicted by arrows 181. By irradiating the sheet S of recording medium provided with the primer, the primer is semi-cured.

Image Formation

Image formation is performed in such a manner that, employing an inkjet printer loaded with inkjet inks, ink droplets are ejected from the inkjet heads based on the digital signals onto a print medium.

In FIG. 1, 11 represents an inkjet marking module comprising four inkjet marking devices, indicated with 111, 112, 113 and 114, each arranged to eject an ink of a different color (e.g. Cyan, Magenta, Yellow and blacK). The nozzle pitch of each head is e.g. about 360 dpi. In the present invention, "dpi" indicates a dot number per 2.54 cm.

Figure 2A:
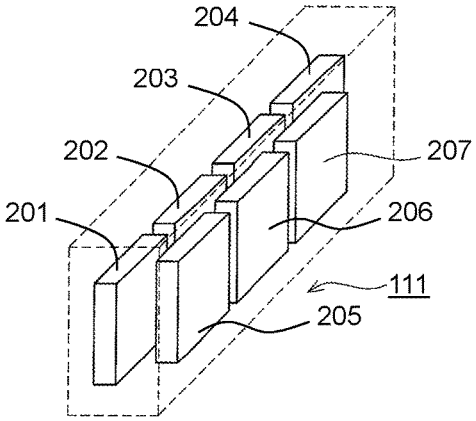
FIG. 2A-2B show an assembly of inkjet heads.
Figure 2B:
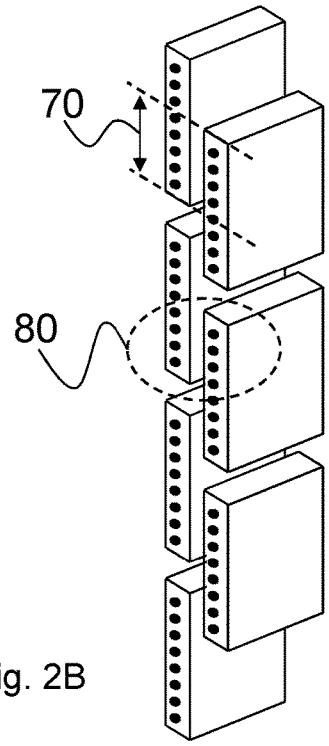
Figure 2C:
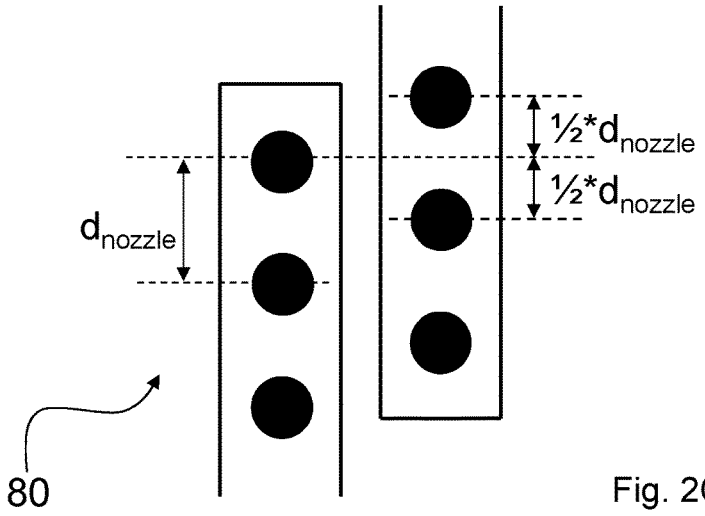
FIG. 2C shows a detailed view of a part of the assembly of inkjet heads.

An inkjet marking device for use in single pass inkjet printing, 111, 112, 113, 114, has a length, of at least the width of the desired printing range. The inkjet marking device may comprise a single print head having a length of at least the width of said desired printing range. The inkjet marking device may also be constructed by combining two or more inkjet heads, such that the combined lengths of the individual inkjet heads cover the entire width of the printing range. Such a constructed inkjet marking device is also termed a page wide array (PWA) of print heads. FIG. 2A shows an inkjet marking device 111 (112, 113, 114 may be identical) comprising 7 individual inkjet heads (201, 202, 203, 204, 205, 206, 207) which are arranged in two parallel rows, a first row comprising four inkjet heads (201-204) and a second row comprising three inkjet heads (205-207) which are arranged in a staggered configuration with respect to the inkjet heads of the first row. The staggered arrangement provides a page wide array of nozzles which are substantially equidistant in the length direction of the inkjet marking device. The staggered configuration may also provide a redundancy of nozzles in the area where the inkjet heads of the first row and the second row overlap, see 70 in FIG. 2B. Staggering may further be used to decrease the nozzle pitch (hence increasing the print resolution) in the length direction of the inkjet marking device, e.g. by arranging the second row of inkjet heads such that the positions of the nozzles of the inkjet heads of the second row are shifted in the length direction of the inkjet marking device by half the nozzle pitch, the nozzle pitch being the distance between adjacent nozzles in an inkjet head, $d_{nozzle}$ (see FIG. 2C, which represents a detailed view of 80 in FIG. 2B). The resolution may be further increased by using more rows of inkjet heads, each of which are arranged such that the positions of the nozzles of each row are shifted in the length direction with respect to the positions of the nozzles of all other rows.

In image formation by ejecting an ink, an inkjet head (i.e. print head) employed may be either an on-demand type or a continuous type inkjet head. As an ink ejection system, there may be usable either the electric-mechanical conversion system (e.g., a single-cavity type, a double-cavity type, a bender type, a piston type, a shear mode type, or a shared wall type), or an electric-thermal conversion system (e.g., a thermal inkjet type, or a Bubble Jet type (registered trade name)). Among them, it is preferable to use a piezo type inkjet recording head which has nozzles of a diameter of 30 μm or less in the current image forming method.

FIG. 1 shows that after pre-treatment, the receiving medium P is conveyed to upstream part of the inkjet marking module 11. Then, image formation is carried out by each color ink ejecting from each inkjet marking device 111, 112, 113 and 114 arranged so that the whole width of the receiving medium P is covered.

Optionally, the image formation may be carried out while the receiving medium is temperature controlled. For this purpose a temperature control device 19 may be arranged to control the temperature of the surface of the transportation mechanism (e.g. belt or drum) underneath the inkjet marking module 11. The temperature control device 19 may be used to control the surface temperature of the receiving medium P, for example in the range of 30° C. to 60° C. The temperature control device 19 may comprise heaters, such as radiation heaters, and a cooling means, for example a cold blast, in order to control the surface temperature of the receiving medium within said range. Subsequently and while printing, the receiving medium P is conveyed to the downstream part of the inkjet marking module 11.

Fixing

After an image has been formed on the receiving medium, the image has to be fixed onto the receiving medium. Fixing is done by curing the ink and primer by irradiating the sheets S of receiving media using suitable radiation.

Figure 3:
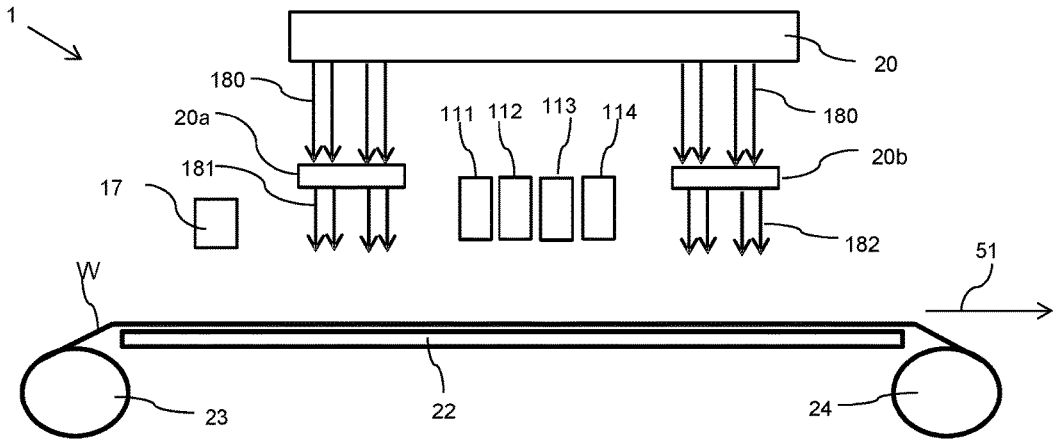
FIG. 3 shows a schematic representation of a second example of an inkjet printing system.

FIG. 3 schematically shows a curing unit 20, which may comprise a radiation source for emitting radiation. The radiation source may be e.g. a UV lamp, such as a Hg bulb or a UV LED lamp. After an image has been formed, the print is conveyed to and passed through the drying and curing unit 20. The curing unit 20 emits radiation (schematically depicted as arrows 181) onto the recording medium provided with the undercoat liquid and the radiation curable ink composition. The residence time of the print in the drying and fixing unit 20 and the intensity and spectrum of the radiation 182 are optimized, such that when the print leaves the curing unit 20 a dry and robust print has been obtained. As described above, the transportation mechanism 12 in the curing unit 20 may be separated from the transportation mechanism of the pre-treatment and printing section of the printing apparatus and may comprise a belt or a drum.

FIG. 3 shows a second example of shows a schematic representations of a first example of an inkjet printing system 1. The inkjet printing system 1 shown in FIG. 3 is a roll-to-roll printer system. The printer system 1 comprises a media support 22. The media support may be a platen configured to support the recording medium during printing, including priming and curing.

The printer system comprises a supply roll 23. The supply roll 23 comprises a roll of recording medium. The printer system further comprises a take-up roll 24. The take-up roll is configured to take up the recording medium that has been provided with a cured image. During printing operation, the recording medium moves from the supply roll 23 to the take-up roll 24.

The printing system 1 comprises a curing unit 20. The curing unit in operation provided radiation, which is schematically depicted by arrows 8. The radiation emitted by the curing unit may have an intensity and a spectrum. The radiation emitted by the curing unit is used for both semi-curing of the undercoat liquid and curing of the ink including the undercoat liquid. Part of the radiation 180 emitted by the curing unit passes through a first filter 20*a*. The first filter 20*a* is selected such, that the radiation that passes the first filter 20*a*—schematically depicted as arrows 181—has an intensity and spectrum suitable for semi-curing the undercoat liquid.

An different part of the radiation 180 emitted by the curing unit passes through a second filter 20*b*. The second filter 20*b* is selected such, that the radiation that passes the second filter 20*b*—schematically depicted as arrows 182—has an intensity and spectrum suitable for curing the ink and the undercoat liquid.

In printing operation, the web W is advanced from the supply roll 23 towards the take-up roll 24. The printer system 1 comprises a print head 17 for applying the undercoat liquid onto the web W. The advantage of using a print head 17 for locally applying the undercoat liquid is that the positions at which the undercoat liquid is applied may be controlled. For example, the undercoat liquid may only be applied on a position of the recording medium that will be provided with radiation curable ink.

After the undercoat liquid has been applied, the undercoat liquid is semi-cured by irradiation by radiation 181. After the undercoat liquid has been semi-cured, an image is applied onto the recording medium. The image is applied using inkjet marking module 11 previously described with respect to FIG. 1. After the print heads forming the inkjet marking module 11 has provided radiation curable ink onto the recording medium, the ink and the undercoat liquid are cured by irradiation by radiation 182. After the ink and the undercoat liquid have been cured, the web W is further advanced towards the take-up roller 24 and is wounded by the take-up roller.

In FIGS. 1 and 3, the marking module comprises four print heads. However, the marking module may comprise another number of print heads. Further, additional curing units may be provided. For example, a curing unit may be provided downstream in the web transport direction after each print head.

Figure 4:
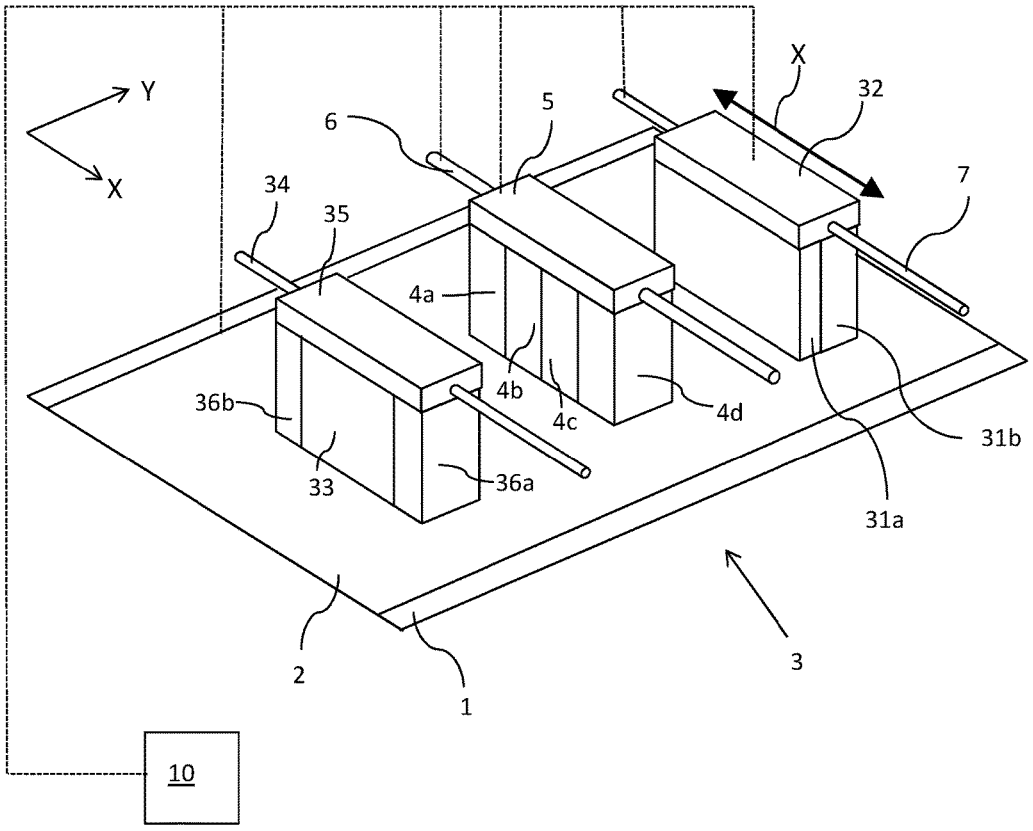
FIG. 4 shows a schematic representation of a third example of an inkjet printing system.

FIG. 4 shows a schematic representation of a third example of an inkjet printing system 3. The ink jet printing assembly 3 comprises supporting means for supporting an image receiving medium 2. The supporting means are shown in FIG. 4 as a flat surface 1, but alternatively, the supporting means may be a platen, for example a rotatable drum that is rotatable around an axis. The supporting means may be optionally provided with suction holes for holding the image receiving medium in a fixed position with respect to the supporting means.

The ink jet printing assembly 3 comprises a print head 33 configured to in operation provide undercoat liquid to the receiving medium 2. The print head 33 is mounted on a carriage 35. The carriage 35 is guided by guiding means 34. These guiding means 34 may be a rod as depicted in FIG. 4. Although only one rod 34 is depicted in FIG. 4, a plurality of rods may be used to guide the carriage 35 carrying the print head 33. The rod may be driven by suitable driving means (not shown). Alternatively, the carriage 35 may be guided by other guiding means, such as an arm being able to move the carriage 35. The carriage 35 further carries two radiation emitting units 36*a*, 36*b*. These radiation emitting units 36*a*, 36*b* are configured to in operation emit radiation onto the undercoat liquid applied onto the receiving medium, thereby semi-curing the undercoat liquid.

The ink jet printing assembly 3 comprises print heads 4*a*-4*d*, mounted on a scanning print carriage 5. The scanning print carriage 5 is guided by suitable guiding means 6 to move in reciprocation in the main scanning direction X. Each print head 4*a*-4*d* comprises an orifice surface 9, which orifice surface 9 is provided with at least one orifice 8, as is shown in FIG. 4. The print heads 4*a*-4*d* are configured to eject droplets of marking material onto the image receiving medium 2.

The image receiving medium 2 may be a medium in web or in sheet form and may be composed of e.g. paper, cardboard, label stock, coated paper, plastic or textile. Alternatively, the image receiving medium 2 may also be an intermediate member, endless or not. Examples of endless members, which may be moved cyclically, are a belt or a drum. The image receiving medium 2 is moved in the sub-scanning direction Y over the flat surface 1 along four print heads 4*a*-4*d* provided with a fluid marking material.

A scanning print carriage 5 carries the four print heads 4*a*-4*d* and may be moved in reciprocation in the main scanning direction X parallel to the platen 1, such as to enable scanning of the image receiving medium 2 in the main scanning direction X. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving medium 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guiding means 6. These guiding means 6 may be a rod as depicted in FIG. 4. Although only one rod 6 is depicted in FIG. 4, a plurality of rods may be used to guide the carriage 5 carrying the print heads 4. The rod may be driven by suitable driving means (not shown). Alternatively, the carriage 5 may be guided by other guiding means, such as an arm being able to move the carriage 5. Another alternative is to move the image receiving material 2 in the main scanning direction X.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 are arranged in a single linear array parallel to the sub-scanning direction Y. Alternatively, the nozzles may be arranged in the main scanning direction X.

As depicted in FIG. 4, the respective print heads 4*a*-4*d* are placed parallel to each other. The print heads 4*a*-4*d* may be placed such that corresponding orifices 8 of the respective print heads 4*a*-4*d* are positioned in-line in the main scanning direction X. This means that a line of image dots in the main scanning direction X may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction X. The image dots are formed by ejecting droplets of marking material from the orifices 8.

The ink jet printing assembly 3 may further comprise curing means 31*a*, 31*b*. As shown in FIG. 4, a scanning print carriage 32 carries the two curing means 31*a*, 31*b* and may be moved in reciprocation in the main scanning direction X parallel to the platen 1, such as to enable scanning of the image receiving medium 2 in the main scanning direction X. Alternatively, more than two curing means may be applied. It is also possible to apply page-wide curing means. If page-wide curing means are provided, then it may not be necessary to move the curing means in reciprocation in the main scanning direction X. The first curing means 31*a* may emit a first beam of UV radiation, the first beam having a first intensity. The first curing means 31*a* may be configured to provide the radiation for the pre-curing step. The second curing means 31*b* may emit a second beam of radiation, the second beam of radiation having a second intensity. The second curing means 11*b* may be configured to provide the radiation for the post-curing step.

The carriage 32 is guided by guiding means 7. These guiding means 7 may be a rod as depicted in FIG. 4. Although only one rod 7 is depicted in FIG. 4, a plurality of rods may be used to guide the carriage 32 carrying the curing means 31*a*, 31*b*. The rod 7 may be driven by suitable driving means (not shown). Alternatively, the carriage 32 may be guided by other guiding means, such as an arm being able to move the carriage 32.

The curing means may be energy sources, such as actinic radiation sources, accelerated particle sources or heaters. Examples of actinic radiation sources are UV radiation sources or visible light sources. UV radiation sources are preferred, because they are particularly suited to cure UV curable inks by inducing a polymerization reaction in such inks. Examples of suitable sources of such radiation are lamps, such as mercury lamps, xenon lamps, carbon arc lamps, tungsten filaments lamps, light emitting diodes (LED's) and lasers. In the embodiment shown in FIG. 4, the first curing means 31*a* and the second curing means 31*b* are positioned parallel to one another in the sub scanning direction Y. The first curing means 31*a* and the second curing means 31*b* may be the same type of energy source or may be different type of energy source. For example, when the first and second curing means 31*a*, 31*b*, respectively both emit actinic radiation, the wavelength of the radiated emitted by the two respective curing means 31*a*, 31*b* may differ or may be the same. The first and second curing means are depicted as distinct devices. However, alternatively, only one source of UV radiation emitting a spectrum of radiation may be used, together with at least two distinct filters. Each filter may absorb a part of the spectrum, thereby providing two beams of radiation, each one having intensity different from the other.

The flat surface 1, the temperature control means, the carriage 35, the print head 33, the radiation emitting units 36*a*, 36*b*, the carriage 5, the print heads 4*a*-4*d*, the carriage 32 and the first and second curing means 31*a*, 31*b* are controlled by suitable controlling means 10.

EXPERIMENTS AND EXAMPLES

Materials

SR 9003 (propoxylated neopentyl glycol diacrylate) and SR355 (di-trimethylolpropane tetraacrylate) were obtained from Sartomer. VEEA (2-(2-vinyloxy ethoxy)ethyl acrylate) was obtained from Nippon Shokubai, Japan. Omnipol 910 was obtained from IGM. The black pigment dispersion, comprising 25 wt % of pigment black dispersed in SR 9003, was obtained from Sun Chemical. Diphenyliodonium hexafluororphosphate was obtained from Sigma Aldrich, Genocure ITX was obtained from Rahn. All chemicals were used as received.

As recording medium, MPI2000 (a vinyl substrate) from Avery Denisson was used.

Methods

Rodcoatinq

Rodcoats were made by applying a 12 μm thick layer of onto a receiving medium. As receiving medium, Avery Dennison MPI2000 was used. MPI2000 is a self-adhesive vinyl medium. Both the undercoat liquid and the radiation-curable ink composition were applied onto the receiving medium as a 12 μm thick layer.

Adhesion tests

Adhesion was investigated using the Cross Hatch ASTM d3359 test procedure. Based on the outcome of the test procedure, the tested samples were awarded a mark in the range 0-8, where 0 corresponds to very low adhesion and 8 for excellent adhesion.

Undercoat liquid

An undercoat liquid was prepared by mixing 93 grams of VEEA, 2 grams of diphenyliodonium hexafluorophosphate and 5 grams of Genocure ITX.

Radiation-Curable ink composition

A radiation curable ink composition was prepared by adding together 22.2 grams of VEEA, 25.2 grams of SR9003, 22.6 grams of SR355 and 3.0 grams of Omnipol 910. To this mixture, 27.0 grams of a pigment dispersion was added, resulting in the formation of an ink composition.

Semi-curing of the undercoat layer

The undercoat layer was semi-cured by irradiating the ink layer using a LED lamp. The rodcoats were transported under the lamp 1 time at a speed of 15 m/min. The LED lamp was a Phoseon FP300 150x20WC395 lamp having a peak irradiance of 20 W/cm$^2$ peak at 395 nm wavelength.

Curing of the undercoat layer

The undercoat layer was semi-cured by irradiating the ink layer using a LED lamp. The rodcoats were transported under the lamp 3 times at a speed of 15 m/min. The LED lamp was a Phoseon FP300 150x20WC395 lamp having a peak irradiance of 20 W/cm$^2$ peak at 395 nm wavelength.

Curing of the ink layer.

The ink was cured by irradiating the ink layer using a LED lamp. The rodcoats were transported under the lamp 1 time at a speed of 15 m/min. The LED lamp was a Phoseon FP300 150x20WC395 lamp having a peak irradiance of 20 W/cm$^2$ peak at 395 nm wavelength.

EXAMPLE AND COMPARATIVE EXAMPLES

Example

The undercoat liquid was applied by rodcoating. Subsequently, the undercoat liquid was semi-cured. The radiation-curable ink composition was applied by rodcoating. Subsequently, the ink composition was cured, thereby hardening the undercoat liquid and the ink.

The resulting print sample is Example 1. Example 1 is a print sample in accordance with the present invention.

Comparative Example 1

The undercoat liquid was applied by rodcoating. Subsequently, the undercoat liquid was cured. The radiation-curable ink composition was applied by rodcoating. Subsequently, the ink composition was cured. The resulting print sample is Comparative Example 1. Comparative Example 1 is a not print sample in accordance with the present invention.

Comparative Example 2

The radiation-curable ink composition was applied by rodcoating onto the receiving medium. No undercoat liquid was applied. The ink composition was cured.

The resulting print sample is Comparative Example 2. Comparative Example 2 is a not print sample in accordance with the present invention.

Comparison Experiment

Adhesion tests were performed on the example and the comparative examples.

The results are summarized in table 1.

TABLE 1

| Adhesion test | |
|---|---|
| Sample: | result |
| Experiment 1 | 6-7 |
| Comparative Experiment 1 | 2 |
| Comparative Experiment 2 | 3 |

The print sample referred to as experiment 1 showed good adhesion. The print sample referred to as Comparative Experiment 1, which was not a print example according to the present invention showed poor adhesion. The print sample referred to as Comparative Experiment 2, which does not comprise an undercoat liquid showed even poorer adhesion.

Thus, the print sample prepared according to the present invention showed improved adhesion compared to print samples that were not prepared according to the present invention. Hence, using a method according to the present invention, improved adhesion can be obtained.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention claimed is:

1. A method for applying an image onto a recording medium, the method comprising the steps of:

a) applying an undercoat liquid onto the recording medium, wherein the undercoat liquid is radiation-curable composition comprising a cationically polymerisable component and a cationic photo-initiator, wherein the cationically polymerisable component is a component that is both cationically and radically polymerisable;

b) semi-curing the undercoat liquid onto the recording medium;

c) applying a radiation-curable ink composition on the semi-cured undercoat liquid, wherein the radiation-curable ink composition comprising a cationically polymerisable component, a radically polymerisable component, and a radical photo-initiator; and d) curing the radiation-curable ink composition and the undercoat liquid.

2. The method according to claim 1, wherein the ink composition further comprises a gelling agent.

3. The method according to claim 1, wherein the recording medium is a textile medium.

4. The method according to claim 1, wherein the cationically polymerisable component is a vinylether acrylate.

5. The method according to claim 1, wherein the method further comprises the step of:

e) heating the radiation-curable ink composition and the undercoat liquid applied onto the recording medium.

6. A Printer apparatus comprising a first application unit for applying an undercoat liquid onto a recording medium;

a second application unit for applying a radiation-curable ink composition;

a curing unit; and a control unit configured to control the printer to perform a method according to claim 1.

7. The printer apparatus according to claim 6, wherein the printer further comprises heating means.

8. The printer apparatus according to claim 6, wherein the curing unit comprises a first curing unit for semi-curing the undercoat liquid and a second curing unit for curing the radiation-curable ink composition.

* * * * *